US007016510B2

(12) United States Patent
Arndt et al.

(10) Patent No.: US 7,016,510 B2
(45) Date of Patent: Mar. 21, 2006

(54) HEARING AID AND OPERATING METHOD FOR AUTOMATICALLY SWITCHING TO A TELEPHONE MODE

(75) Inventors: Georg-Erwin Arndt, Obermichelbach (DE); Thomas Fischer, Erlangen (DE); Thomas Hanses, Feldkirchen-Westerham (DE); Henning Puder, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 10/961,771

(22) Filed: Oct. 11, 2004

(65) Prior Publication Data

US 2005/0117764 A1 Jun. 2, 2005

(30) Foreign Application Priority Data

Oct. 10, 2003 (DE) ..... 103 47 212

(51) Int. Cl.
*H04R 25/00* (2006.01)

(52) U.S. Cl. ..... 381/312; 381/315; 381/331

(58) Field of Classification Search ..... 381/60, 381/61, 81, 107, 111, 312, 314, 315, 317, 381/320, 321, 71.6, 94.1; 379/52
See application file for complete search history.

(56) References Cited

U.S. PATENT DOCUMENTS

| | | | | |
|---|---|---|---|---|
| 6,760,457 | B1 * | 7/2004 | Bren et al. | 381/331 |
| 6,763,116 | B1 * | 7/2004 | Barthel et al. | 381/312 |
| 2003/0076974 | A1 | 4/2003 | Barthel et al. | 381/312 |

FOREIGN PATENT DOCUMENTS

| | | |
|---|---|---|
| DE | 101 46 886 | 4/2003 |
| WO | WO 01/52597 | 7/2001 |

* cited by examiner

*Primary Examiner*—Huyen Le
(74) *Attorney, Agent, or Firm*—Schiff Hardin LLP

(57) ABSTRACT

In a hearing aid and method for automatically switching to a telephone mode, for automatically detecting a telephone situation for the wearer given a binaural supply, the difference between the levels of the input signals of the two hearing devices is measured and compared with at least one threshold value. If the difference in levels drops below or exceeds the threshold value, the respective hearing device is switched to the telephone mode.

16 Claims, 1 Drawing Sheet

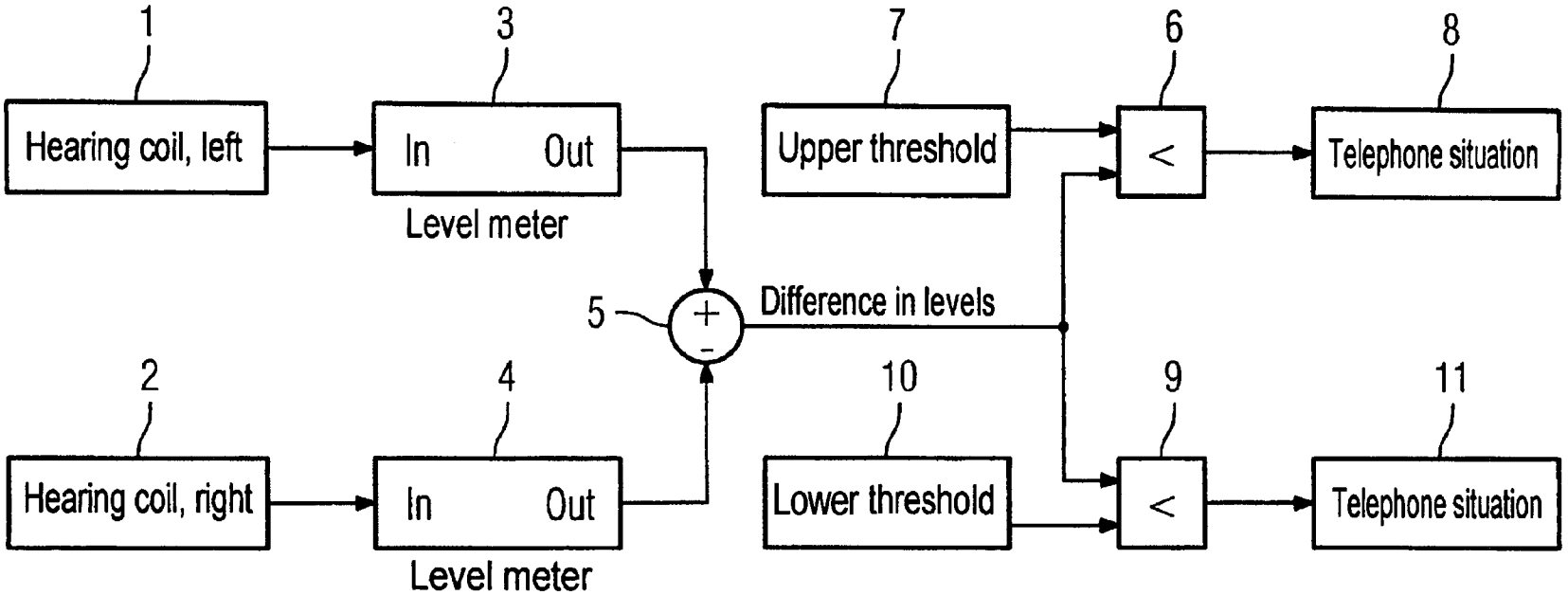
1
Hearing coil, left
3
In
Out
Level meter
2
Hearing coil, right
4
In
Out
Level meter
5
+
-
Difference in levels
6
V
7
Upper threshold
8
Telephone situation
9
V
10
Lower threshold
11
Telephone situation

HEARING AID AND OPERATING METHOD FOR AUTOMATICALLY SWITCHING TO A TELEPHONE MODE

BACKGROUND OF THE INVENTION

1. Field of the Invention

The present invention relates to a hearing aid for automatically switching to a telephone mode of the type having a first hearing device including a first receiving device for receiving a first input signal, and a second hearing device including a second receiving device for receiving a second input signal. Furthermore, the present invention relates to a corresponding method for automatically switching to a telephone mode.

2. Description of the Prior Art

Modern hearing devices are usually capable of coping with different hearing situations by being able to be switched into different hearing programs by the wearer of the hearing aid. A typical hearing program is the telephone hearing program in which acoustic signals which are picked up by the microphone of the hearing device are filtered in accordance with the frequency spectrum of telephone signals in order to suppress disruptive ambient noises in other spectral ranges.

In addition to one or more microphones, induction receivers which permit a hearing coil mode are provided in hearing devices. This ensures that acoustic signals are transmitted inductively to the hearing device by a telephone device which has an inductively operating loudspeaker. The disruptive sound which is picked up from the surroundings by means of the microphones is then not amplified or transmitted by the hearing device when the wearer makes a phone call.

A problem when switching between the individual hearing programs is the unambiguous detection of a telephone situation. An approach to this is known from PCT application WO 0152597. In this document, the audio signal that is transmitted by the hearing coil is analyzed. If there are signal components which are typical of the telephone mode, the device is switched into the hearing coil mode.

EP 1 298 959 A2 also discloses a method with which the hearing coil signal is analyzed in order to switch automatically into the hearing coil mode or telephone mode. In this context, interference signals which can arise, for example, due to cordless telephones or mobile telephones according to the DECT or GSM transmission standard are used as the basis for a switching signal.

DE 101 46 886 A1 also describes a method with which it is to be possible to detect automatically if the wearer of the hearing aid is making a telephone call. In this methods the signal from the hearing coil and the signal from the microphone of the hearing device are compared with one another and a corresponding switching signal is generated.

The methods described above have the common factor that they are comparatively sensitive to interference.

SUMMARY OF THE INVENTION

An object of the present invention is to provide a device and a method with which a situation in which the wearer of a hearing device is making a telephone call can be detected with a relatively high level of reliability.

This object is achieved according to the invention by a hearing aid for automatically switching to a telephone mode having a first hearing device including a first receiving device for receiving a first input signal, and a second hearing device with a second receiving device for receiving a second input signal, as well as a level measuring device for measuring a difference in levels between the two input signals, and a control device for switching at least one of the two hearing devices to the telephone mode if the difference in levels drops below or exceeds at least one predefined threshold value.

In addition, the invention provides a method for automatically switching to a telephone mode by acquiring a first input signal in a first hearing device and acquiring a second input signal in a second hearing device and measuring a difference in levels between the two input signals and switching at least one of the two hearing devices to the telephone mode if the difference in levels drops below or exceeds at least one predefined threshold value.

Preferably each of the first and second receiving devices is a hearing coil. Significantly greater differences in levels can be detected in the hearing coils of the two hearing devices during a telephone call than in microphones because a telephone call is usually not made in anechoic spaces.

The level-measuring device can include two level meters for measuring the absolute level of the first and second input signals. The difference in levels between the two input signals can then be formed in the control unit by means of a subtractor or divider, but also by means of bit arithmetic. This has the advantage that if appropriate both the absolute levels and the difference in levels are available for an "intelligent" evaluation of the input signals.

At least one of the two input signals can be an inductively transmitted signal of an analog telephone. As a result, the inductively transmitted speech signal of the analog telephone forms the basis for the determination of the difference in levels and consequently the basis for the switching of at least one of the two hearing devices.

When a telephone call is made with a radio telephone, whether a cordless telephone according to the DECT standard or a mobile telephone according to the GSM standard or some other standard, it is possible for one of the two input signals to be an electromagnetically input radio frequency signal. By means of the interference which disrupts the customary speech signals it is possible to detect the telephone mode with a digital telephone on the basis of the difference in levels at the left and right hearing devices, and to carry out corresponding filtering automatically.

By means of the level measuring device it is, if appropriate, also possible to determine the level of a predefined periodic signal component of an input signal. In particular this is advantageous if the periodic signal component is characteristic of an electromagnetic interference signal of a radio telephone. As a result, it is possible to detect signal components of cordless telephones and mobile radio telephones using, for example, a matched filter, and to evaluate said components for the purpose of binaural detection of a telephone.

In comparison to the detection of a telephone according to the prior art by analyzing a single hearing coil signal by means of the interference signals in a hearing coil signal or by means of the comparison of a hearing coil signal with a microphone signal, binaural detection of a telephone is much less sensitive to interference. If, as in the known solutions, only the signal of a single hearing coil is analyzed, incorrect detections may occur due to other electromagnetic interference, for example 50 Hz humming. However, since this interference influences both the hearing coil of a left-hand hearing device and a hearing coil of a right-hand hearing device, the difference between the levels of the two hearing coil signals will never become as large as in a telephone situation in which the source of the electromagnetic signal is positioned very near to one of the two hearing devices. By means of this unambiguous detection of a telephone it is then possible to switch automatically to a telephone program which simplifies or qualitatively improves the making of telephone calls for the wearers of hearing devices.

DESCRIPTION OF THE DRAWINGS

The single FIGURE is a block diagram showing the automatic detection of a telephone situation given a binaural supply in accordance with the invention.

DESCRIPTION OF THE PREFERRED EMBODIMENTS

The exemplary embodiment which is specified in more detail below constitutes a preferred embodiment of the present invention.

According to the present invention, a telephone signal is detected using a binaural connection between a left-hand hearing device and a right-hand hearing device. Use is made of the fact that in a telephone situation there are differences in level between the alternating voltage signals between the hearing coils of the left-hand hearing device and the right-hand hearing device. As a rule the entire frequency range is considered in order to determine the differences in level.

When a telephone call is made with an analog telephone, the transmitted speech is input inductively into the respective hearing coil. In contrast to this, in radio telephones, the digital transmission causes interference signals to be input electromagnetically into the hearing coil either directly or in the form of interference. In all cases there is a difference in levels between the left hearing coil signal and the right hearing coil signal since the telephone transmits signals only in one of the two hearing devices.

A technical implementation of the hearing aid according to the invention for automatically detecting a telephone situation is illustrated in the FIGURE in the form of a basic block diagram. The hearing impaired person who has a binaural supply wears two hearing devices. The left hearing device has a hearing coil 1, and the right hearing device has a hearing coil 2. A level meter 3 measures the absolute level of the hearing coil signal of the hearing coil 1. Equally, a second level meter 4 measures the absolute level of the hearing coil signal of the hearing coil 2. The difference in levels is determined from the two level values of the level meter 3 and the level meter 4 using a subtractor 5.

The difference in levels is compared with an upper threshold value 7 using a first comparator 6. This upper threshold value can be predefined as desired. If the difference in levels between the two hearing coil signals is greater than the upper threshold value 7, the hearing impaired person is making a telephone call, for example at his or her left ear. Correspondingly, the device is switched to the telephone situation 8 at the left ear.

However, since the hearing impaired person can also make a telephone call at his or her right ear, in this case a negative level difference is produced, and this must be compared with a lower threshold value 10 using a second comparator 9. If the difference in levels is smaller than the lower threshold value 10, the right-hand hearing device is switched to the telephone mode 11. This ensures that only that hearing device which is supplying the hearing impaired person's ear against which the telephone receiver is placed is switched automatically to the telephone mode, This results in a telephone situation which is the same as for a person with normal hearing.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing aid comprising:

A first hearing device, adapted to be worn at one ear of a hearing-impaired person, having a first receiving device for receiving a first input signal;

a second hearing device, adapted to be worn at the other ear of the hearing-impaired person, having a second receiving device for receiving a second input signal;

a level measuring device supplied with said first and second input signals for measuring a difference in respective levels between said first and second input signals; and a control device for switching at least one of said first or second hearing devices to a telephone mode if said difference is above or below at least one predetermined threshold value.

2. A hearing aid as claimed in claim 1 wherein each of said first receiving device and said second receiving device is a hearing coil.

3. A hearing aid as claimed in claim 1 wherein said level measuring device comprises two level meters for measuring an absolute level of said first and second input signals.

4. A hearing aid as claimed in claim 1 wherein said control device comprises a subtractor unit and a bit arithmetic or division unit for forming said difference.

5. A hearing aid as claimed in claim 1 wherein at least one of said first and second receiving devices is a device for receiving an inductively transmitted signal of an analog telephone.

6. A hearing aid as claimed in claim 1 wherein at least one of said first and second receiving devices is a device for receiving an electromagnetic radio frequency signal of a radio telephone.

7. A hearing aid as claimed in claim 1 wherein said level measuring device determines a level of a predetermined periodic signal component in said first and second input signals.

8. A method for automatically switching a hearing aid to a telephone mode, comprising the steps of:

acquiring a first input signal with a first hearing device at one ear of a hearing-impaired person;

acquiring a second input signal with a second hearing device at the other ear of the hearing-impaired person;

measuring a difference of respective levels of said first and second input signals; and switching at least one of said first and second hearing devices to a telephone mode if said difference deviates from at least one predefined threshold value.

9. A method as claimed in claim 8 comprising receiving each of said first and second input signals inductively.

10. A method as claimed in claim 8 wherein the step of measuring said difference comprises measuring respective absolute levels of said first and second input signals.

11. A method as claimed in claim 8 comprising determining said difference by division of said first and second input signals.

12. A method as claimed in claim 8 comprising determining said difference by bit displacement of said first and second input signals.

13. A method as claimed in claim 8 comprising determining said difference by subtraction of said first and second input signals.

14. A method as claimed in claim 8 comprising receiving at least one of said first and second input signals as an inductively transmitted signal from an analog telephone.

15. A method as claimed in claim 8 comprising receiving at least one of said first and second input signals as an electromagnetically input radio frequency signal from a radio telephone.

16. A method as claimed in claim 8 comprising measuring said difference with respect to a predetermined periodic signal component of said first and second input signals.

* * * * *